US006089499A

United States Patent [19]

Robinson

[11] Patent Number: 6,089,499

[45] Date of Patent: Jul. 18, 2000

[54] DUAL ROLL, CENTER PULL, PAPER TOWELING DISPENSER

[76] Inventor: Robert S. Robinson, 6337 Morris Rd., Hamilton, Ohio 45011

[21] Appl. No.: 08/954,350

[22] Filed: Oct. 17, 1997

[51] Int. Cl.[7] ..... B65H 23/06

[52] U.S. Cl. ..... 242/593; 242/560

[58] Field of Search ..... 242/560, 560.1, 242/593

[56] References Cited

U.S. PATENT DOCUMENTS

| | | | |
|---|---|---|---|
| 2,805,030 | 9/1957 | Wolters . | |
| 2,908,450 | 10/1959 | Stone et al. . | |
| 3,010,670 | 11/1961 | Jones et al. . | |
| 3,329,366 | 7/1967 | Batlas et al. . | |
| 4,760,970 | 8/1988 | Larsson et al. . | |
| 4,872,601 | 10/1989 | Sigmund | 242/560 |
| 5,205,455 | 4/1993 | Moody | 225/106 |
| 5,219,126 | 6/1993 | Schutz . | |
| 5,246,137 | 9/1993 | Schutz et al. | 221/44 |
| 5,265,816 | 11/1993 | Collins | 242/560 |
| 5,346,064 | 9/1994 | Rizzuto | 206/409 |
| 5,370,338 | 12/1994 | Lewis | 242/593 |
| 5,577,634 | 11/1996 | Morand | 221/43 |
| 5,645,244 | 7/1997 | Moody | 242/560 |
| 5,762,286 | 6/1998 | Schutz | 242/593 |
| 5,762,287 | 6/1998 | Schutz | 242/593 |

FOREIGN PATENT DOCUMENTS

| | | | |
|---|---|---|---|
| 2 269 361 A | 2/1994 | United Kingdom | 242/560 |

OTHER PUBLICATIONS

Kimberly Clark, *Brochure featuring In Sight® Dispensers, 3 pps*, AFH–502–1, Oct. 1996.

James River, *Cleaner, Drier Hands Are At your Finger Tips*, 194.24.

*Primary Examiner*—John P. Darling

*Attorney, Agent, or Firm*—Wood, Herron & Evans, L.L.P.

[57] ABSTRACT

A paper towel dispenser, comprising:

a support structure;

a platform forming a part of the support structure and adapted to support two rolls of center pull paper toweling in side-by-side relationship, the platform having a bottom, a first opening in the bottom, and a second opening in the bottom, each opening capable of receiving paper toweling from an inner end of a roll of center pull paper toweling; and a selectively positionable access-blocking member attached to the support structure, the access-blocking member having a first position and a second position for alternatingly blocking access to one of the first and second openings while providing access to the other one of the first and second openings.

10 Claims, 4 Drawing Sheets

DUAL ROLL, CENTER PULL, PAPER TOWELING DISPENSER

BACKGROUND OF THE INVENTION

1. Field of the Invention

This invention relates to paper towel dispensers and methods of using such dispensers, and in particular, the invention relates to center-pull paper toweling dispensers and methods of using such dispensers.

2. Description of the Related Art

Paper toweling is a part of our daily lives. We use it in the home, at school, at work, in restaurants, in airports, and in numerous other settings. For example, you, no doubt, have been in that frustrating position of using a public restroom, washing your hands, and then turning around to the paper toweling dispenser, only to find that the dispenser is empty! At which point, you are often left with the options of"drip drying", pulling out that personal hand towel that you always carry with you, or using that favorite towel-like section of your dress, suit, or shirt.

Despite the ease and convenience of single-roll, center-pull paper toweling and dispensers, these dispensers simply do not solve this annoying problem. As is often the case in a heavily trafficked area, someone before you has pulled at that last sheet of toweling from the center-pull dispenser before a custodian returned to the restroom or other facility to refill the unit. Alternatively, even if a facility had a custodian or custodians checking and refilling the dispenser with great frequency, a great deal of paper toweling likely would be wasted. For example, in order to avoid an empty dispenser, a custodian likely would remove whatever paper toweling is in the dispenser, throw that toweling away, and fill the dispenser with a new roll, as an alternative to risking the potential for an empty dispenser.

One company has developed a center-pull dispenser assembly which is actually two center-pull dispensers molded together in a side-by-side relationship. If this assembly were installed in a facility, a person using the facility would have the option to pull paper toweling from either the right dispenser or left dispenser of the side-by-side unit. Accordingly, this side-by-side unit would increase the total volume of paper initially available in the dispenser assembly. However, because people using the facility would be able to freely draw toweling from the left and right dispensers at will, there would still be a significant possibility that when you turned to the dispensing unit in search of a sheet of paper toweling, once again, you would come up empty handed. As with the single-roll dispenser, a custodian would either have to be very lucky in his or her timing, or that custodian would have to throw away one or more partially used rolls, in order to restock the unit.

SUMMARY OF THE INVENTION

The present invention overcomes the above-mentioned drawbacks by providing a paper towel dispenser, comprising:

a support structure;

a platform forming a part of the support structure and adapted to support two rolls of center-pull paper toweling in side-by-side relationship, the platform having a bottom, a first opening in the bottom, and a second opening in the bottom, each opening capable of receiving paper toweling from an inner end of a roll of center-pull paper toweling; and a selectively positionable access-blocking member attached to the support structure, the access-blocking member having a first position and a second position for alternatingly blocking access to one of the first and second openings while providing access to the other one of the first and second openings.

These and other objects and advantages of the present invention shall be made apparent from the accompanying drawings and description of the drawings.

BRIEF DESCRIPTION OF THE DRAWINGS

The accompanying drawings, which are incorporated in, and constitute a part of, this specification, illustrate embodiments of the invention, and, together with the general description of the invention given above, and the detailed description of the drawings given below, serve to explain the principals of the invention.

DETAILED DESCRIPTION OF THE DRAWINGS

Figure 1:
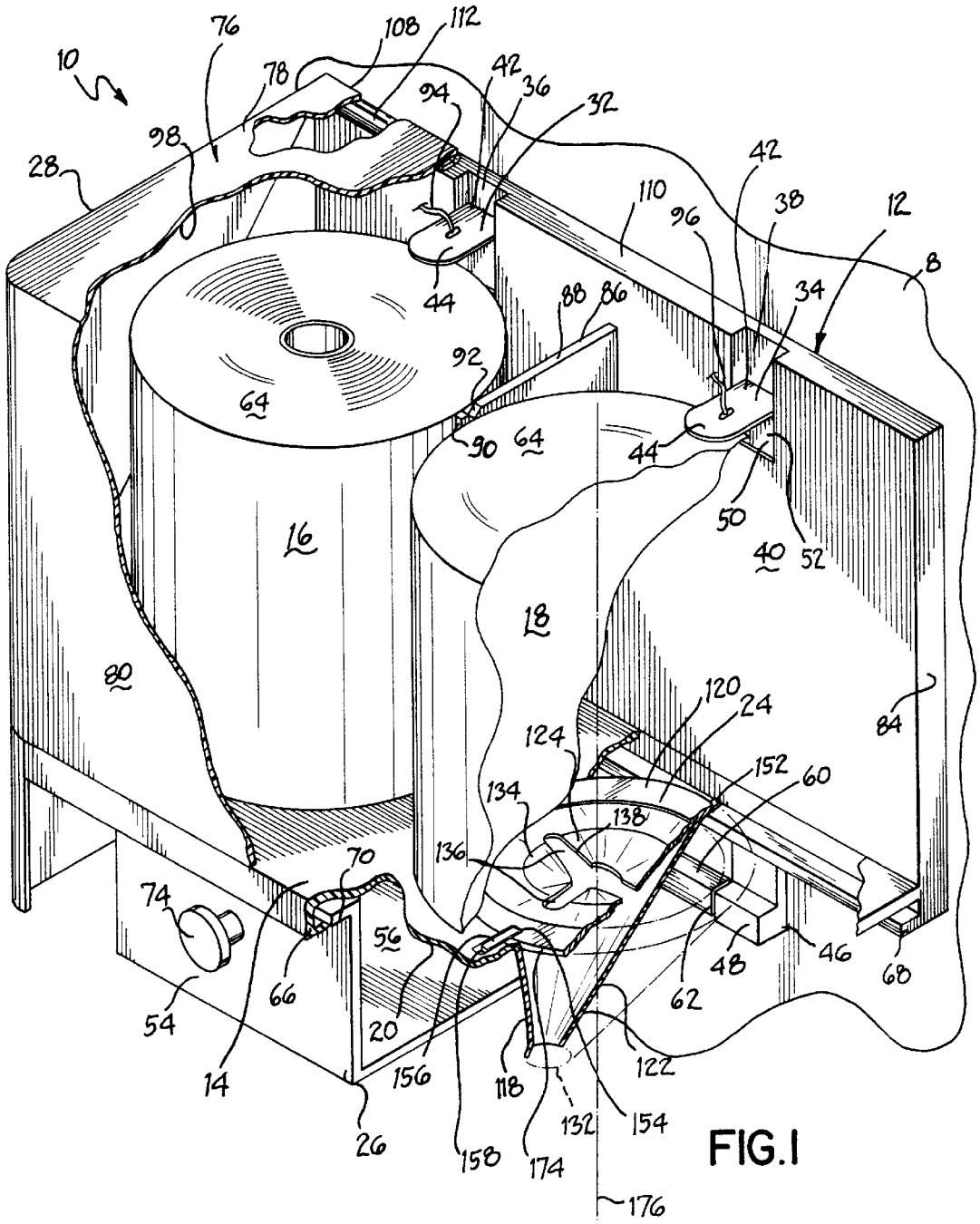
FIG. 1 is a perspective, partially broken-away view of one version of the paper towel dispenser in accordance with the principals of the present invention.
Figure 3:
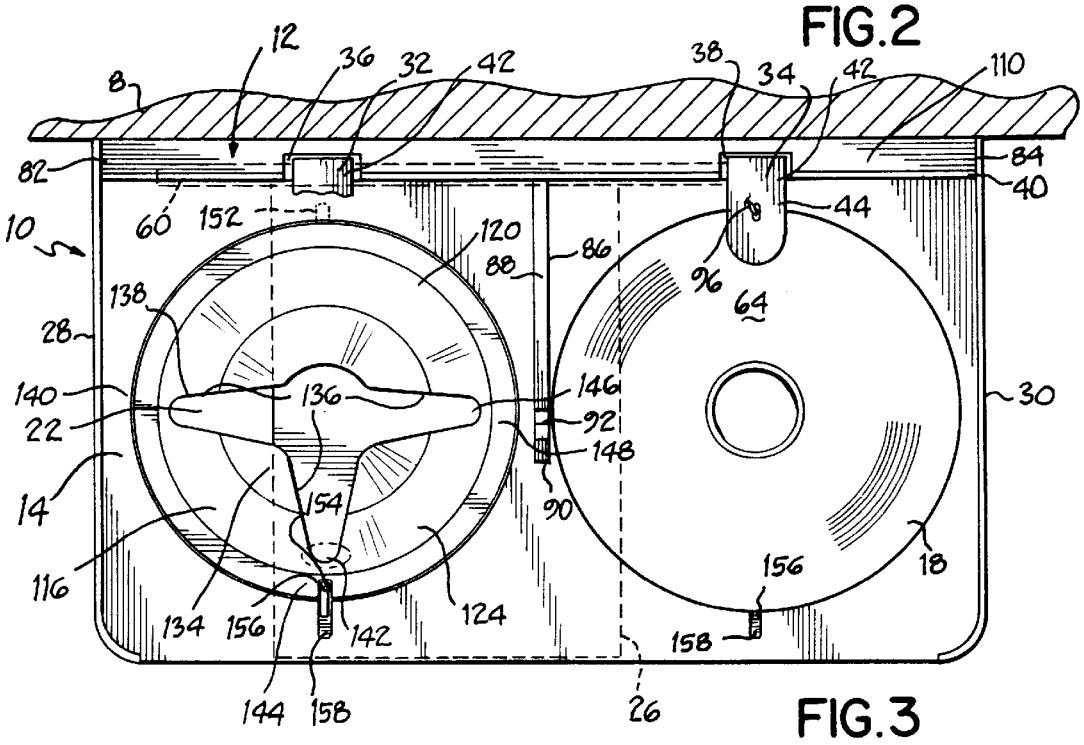
FIG. 3 is a top, partially broken-away view of the paper towel dispenser shown in FIG. 1.

With reference to FIG. 1, one version of the paper towel dispenser according to the principals of the invention is shown. This particular dispenser 10 includes a support structure 12, with a platform 14 forming a part of the support structure 12 and adapted to support two rolls of center-pull paper toweling in side-by-side relationship. As shown in FIG. 1, this particular dispenser 10 is loaded with a left-side roll 16 and a right-side roll 18. The platform 14 itself includes a bottom 20, a first opening in the bottom 20 and a second opening in the bottom 20. As best shown in FIGS. 1 and 3, this particular version of the dispenser 10 includes a left-side opening 22 and a right-side opening 24, in operative position below the left and right-side rolls 16, 18. It should be noted that either the left-side opening 22 or the right-side opening 24 may represent the "first opening" presented in the claims. For example, if the left-side opening 22 is considered to be the first opening, then the right-side opening 24 would represent a "second opening." Conversely, if the right-side opening 24 is considered to be the "first opening," then the left-side opening 22 may be the "second opening."

Figure 2:
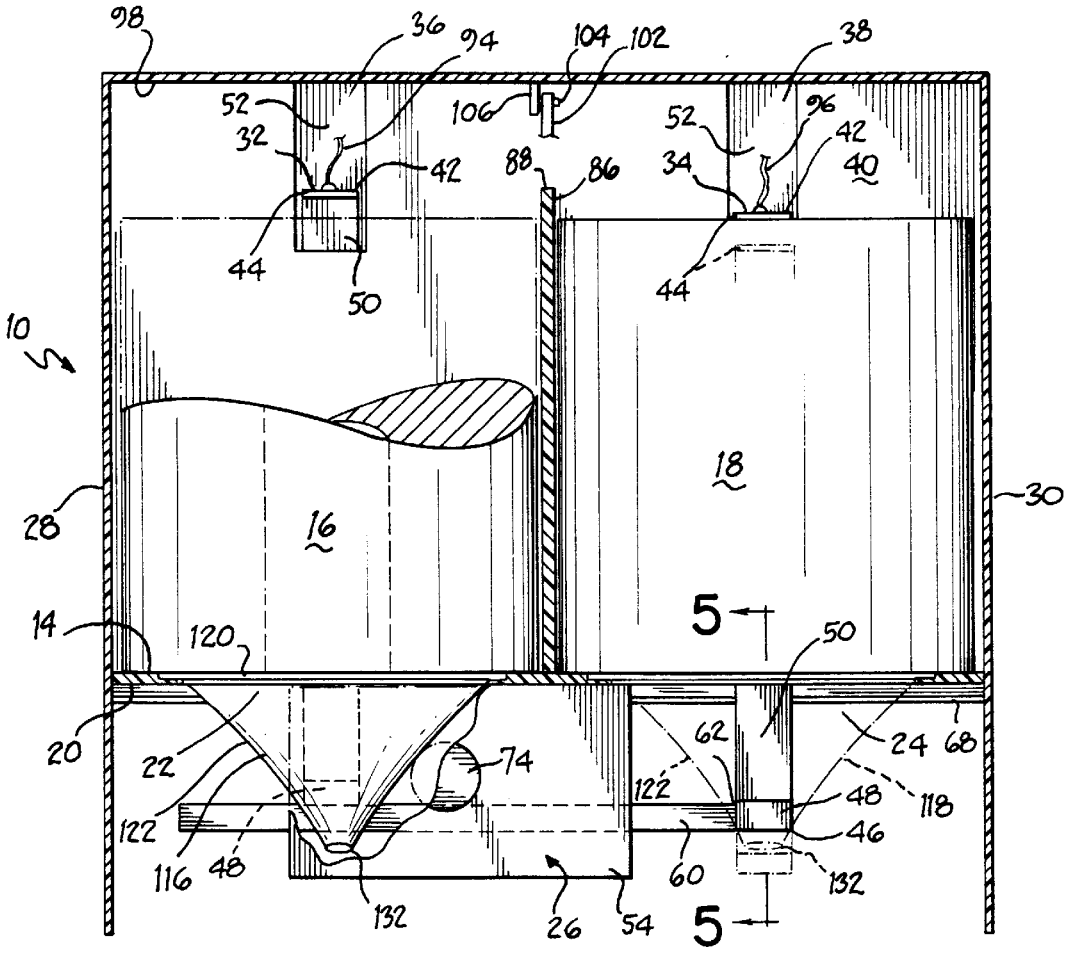
FIG. 2 is a front, partially broken-away view of the paper towel dispenser shown in FIG. 1.

As best shown in FIGS. 1–3, the paper towel dispenser includes a selectively positionable access-blocking member 26 attached to the support structure 12. As shown in these figures, and discussed in further detail below, the access-blocking member 26 has a first position and a second position for alternatingly blocking access to one of the first and second openings while providing access to the other one of the first and second openings. For example, as shown in FIGS. 1–3, the access blocking member 26 is positioned toward the left-side 28 of the dispenser 10, so as to block access to the left-side opening 22, while simultaneously allowing access to the right-side opening 24. Alternatively, and as will be discussed in further detail below, the access blocking member 26 may be positioned toward the right-side 30 of the dispenser 10, in which case, the access blocking member 26 blocks the right-side opening 24, while providing access to the left-side opening 22. With respect to the claims, it should be understood that the left-side position and right-side position of the access blocking member 26 may correspond with the claimed "first position" and "second position." Alternatively, the reverse may be possible, with the right-side blocking member 26 representing a "first position," and the left-side position corresponding with a "second position."

Figure 4:
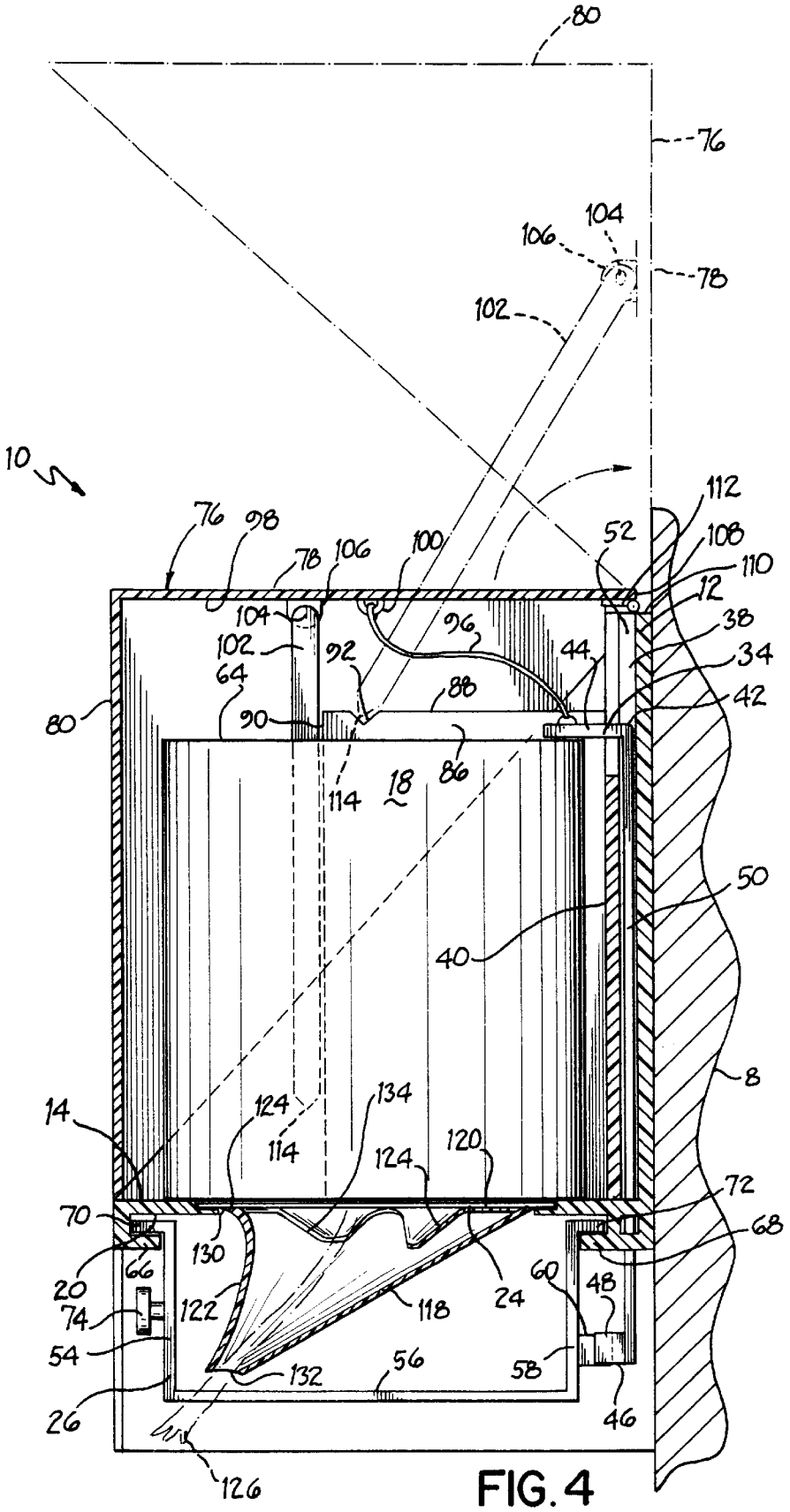
FIG. 4 is a right-side, partially broken-away view of the paper towel dispenser shown in Fig. 1.

As best shown in FIGS. 1, 2 and 4, this version of the dispenser 10 also includes a left-side sensing member 32 and a right-side sensing member 34 slidingly positioned in a left-side channel 36 and a right-side channel 38, respectively, in a back plate 40.

With reference to FIGS. 1 and 4, each of the sensing members 32, 34 includes an upper end 42 with a resting element 44, a lower end 46 with a blocking element 48, and a connecting portion 50 between the upper and lower ends 46, 48. As best shown in FIGS. 1 and 2, each of the left-side and right-side channels 36, 38 includes a partially open face 52, thereby enabling each of the sensing members 32, 34 to move up and down within there respectively channels 36, 38. The importance of the sliding ability of these sensing members 32 and 34 will become more apparent upon a reading of the additional detailed description provided below.

Figure 5:
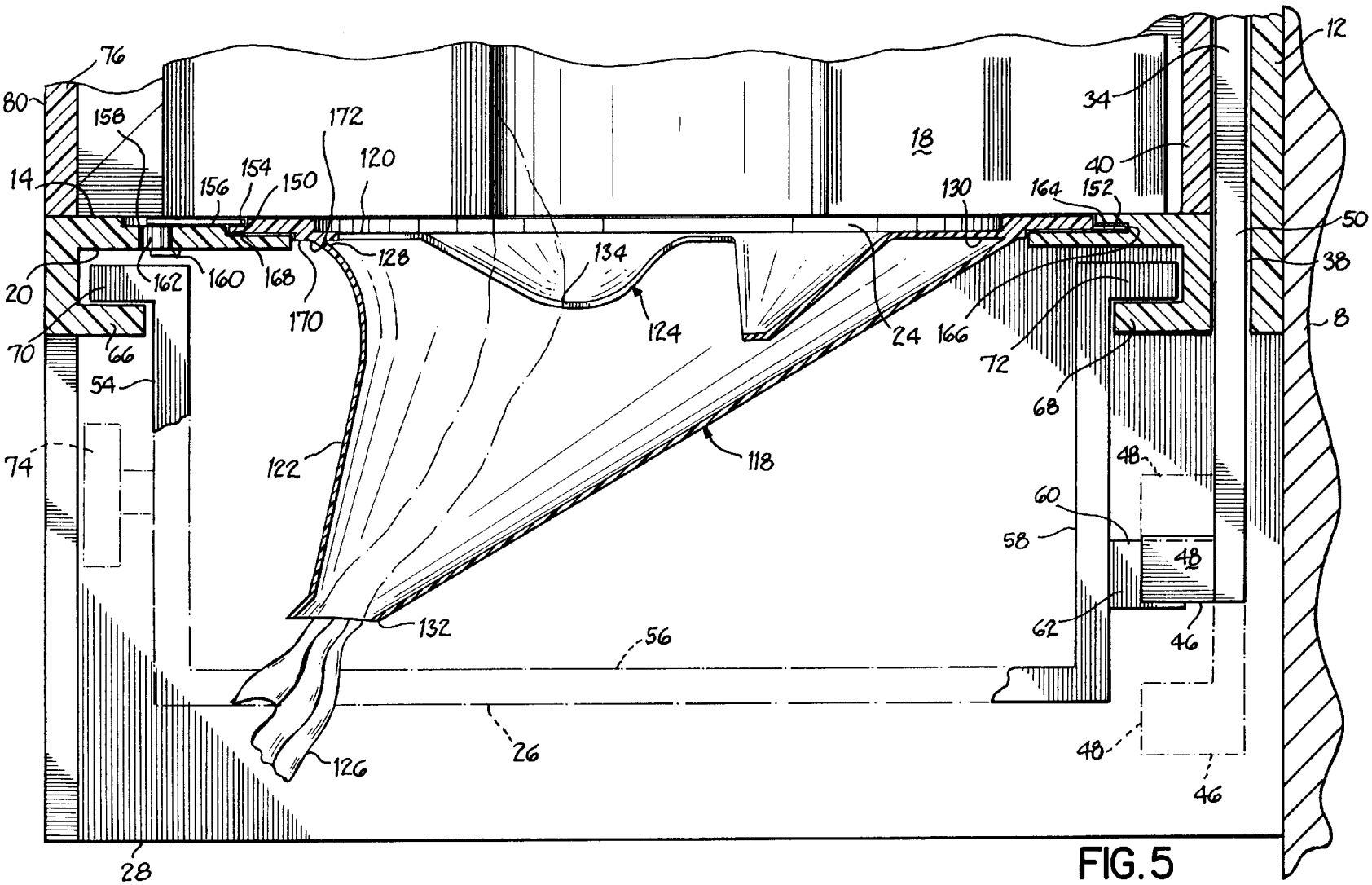
FIG. 5 is a partial right-side, partially broken-away view of the paper towel dispenser shown in FIGS. 1–4, with this particular view being taken along line 5—5 of FIG. 2.

Turning, for a moment, to the access blocking member 26, and with reference to FIGS. 1, 4, and 5, the access blocking member 26 includes a front-side 54, a base 56, and a back-side 58. The back-side 58 further includes an elongated obstruction bar 60.

As best shown in FIGS. 2 and 5, when the dispenser 10 is loaded with two full rolls 16, 18 of center-pull paper toweling, and the access blocking member 26 is positioned toward the left-side 28 of the dispenser 10, then the blocking element 48 of the right-side sensing member 34 is in general alignment with the elongated obstruction bar 60 of access blocking member 26, whereby if one attempts to move the access blocking member 26 toward the right-side 30 of the dispenser 10, the right end 62 of the obstruction bar 60 makes contact with the blocking element 48 of the right-side sensing member 34 sufficient to prevent the access blocking member 26 from being moved to the right-side 28 of the dispenser 10 so as to expose the left-side opening 22. The right-side sensing member 34 is in this particular alignment with the obstruction bar 60 because the resting element 44 of the right-side sensing member 34 is resting on the top surface 64 of the right-side roll 16 of paper toweling.

Again with reference to FIG. 2, the positioning of the left-side sensing member 32 relative to the elongated obstruction bar 60 of the access blocking member 26 is somewhat different. As shown in that Figure, the blocking element 48 of the left-side sensing member 32 is positioned above the obstruction bar 60, and as shown in the figure, the resting element 44 of the left-side sensing member 32 actually is positioned slightly above the top surface 64 of the left-side roll 16 of toweling.

These different positions of the right and left side sensing members 34, 32 may be further appreciated with reference to FIG. 5. This Figure shows the blocking element 48 of the right-side sensing member 34 in blocking alignment with the obstruction bar 60. However, the sensing member 34 and blocking element 48 also are shown in two other positions, represented by the phantom lines. One phantom sketch shows the blocking element 48 positioned above the obstruction bar 60, with the blocking element 48 identified by the letter "A". This positioning of the blocking element 48 of the right-side sensing member 34 is substantially similar to the vertical alignment of the blocking element 48 of the left-side sensing member 32 relative to the obstruction bar 60 as shown in FIG. 2.

In the particular version of the invention shown in the Figures, the access blocking member 26 is slidingly connected to the platform 14. As best shown in FIGS. 4 and 5, this is accomplished by providing the bottom 20 of the platform 14 with a front slide track 66 and a rear slide track 68. In addition, the access blocking member 26 includes a front flange 70 and a rear flange 72 for corresponding with the front slide track 66 and rear slide track 68, respectively. The access blocking member 26 also has a handle 74 on the front side 54 to assist in moving the access blocking member 26 from one side of the dispenser 10 to the other.

In an alternate version of the invention (not shown), the access blocking member 26 may perform its same function in cooperation with the left and right-side sensing members 32, 34, without the access blocking member 26 being connected to the platform 14. For example, the support structure 12 may include a separate mounting bracket for mounting a separate frame beneath the platform 14, with the frame including front and rear slide tracks, or any other feature or features which slidingly connect the particular access blocking member to the separate framework.

Returning back to the particular version of the dispenser 10 shown in the Figures, and with particular reference to FIGS. 1 and 4, the dispenser 10 also includes a cover 76 having a top 78, a front 80 and a right and left-side (not shown), thereby protecting the paper toweling within the dispenser 10. The side walls of the cover 76 are substantially rectangular, as shown by the phantom diagonal line in FIG. 4. Each of these sidewalls has a diagonal ledge which corresponds with an opposing diagonal ledge of a left-side panel 82 of the supporting structure 12 and a right-side panel 84 of the supporting structure 12 (See FIG. 2 for panels 82 and 84).

As shown in FIGS. 1–3, the supporting structure 12 further includes a vertical plate 86 positioned centrally between the left-side opening 22 and right-side opening 24, and connected to the platform bottom 20 and back plate 40. This vertical plate 86 includes a top edge 88 and a front edge 90, with the top edge including a detent 92.

As best shown in FIG. 4, this particular version of the invention further includes a pair of lifting members, in the form of a left-side elasticized band or cord 94 and a right-side elasticized band or cord 96. One end of the right-side band 96 is connected to the resting element 44 of the right-side sensing member 34 while the other end of the band 96 is connected to the inside surface 98 of the top 78 by an eye screw 100. In addition, the dispenser 10 includes a cover prop-rod 102 pivotably mounted by a pin 104 to a bracket 106 depending from the inside surface 98 of the cover top 78, with the positioning of this pivotal mount being slightly toward the front 80 of the cover 76 relative to the eye screw 100, whereby the cover prop-rod 102 rests in a substantially vertical alignment when the cover 76 is in a closed position. The cover 76 further includes a back portion 108 which is flexibly mounted an upper portion 110 of the back plate 40 by a piano hinge 112, thereby enabling the cover 76 to be raised and lowered without becoming separated from the rest of the dispenser 10. Furthermore, as shown in phantom in FIG. 4, the cover 76 may be maintained in an open position (designated by the reference letter "O") by placing the free end 114 of the cover prop rod 102 in the detent 92 on the top edge 88 of the vertical plate 86. This ability to maintain the cover 76 in an open position is particularly beneficial when a custodian installs a new roll or rolls into the dispenser 10.

As shown in the Figures, this particular version of the dispenser 10 also includes a left-side dispensing member 116 and a right-side dispensing member 118. In this particular version of the invention, each of the dispensing members 116, 118 is identical. FIG. 5 shows many of the details of the right-side dispensing side 118 and because of the two dispensing member 116, 118 are identical in this particular version of the invention, the partial cross section shown in FIG. 5 may be used to understand the shape and design of both the left-side and right-side dispensing members 116, 118. Accordingly, with reference to FIG. 5, each dispensing member 116, 118 includes a top portion 120 and a bottom portion 122, with the top portion having an aperture for receiving paper toweling 126 from an inner end of a roll of center-pull paper toweling. The bottom portion 122 of each dispensing member 116, 118 is operatively connected to the top portion 120, with the bottom portion 122 having an upper end 128 connected to the top portion 120, and a lower end 130 having an orifice 132 capable of receiving the paper toweling 126.

As seen most clearly in FIG. 3, the aperture 124 in the top portion 120 includes a substantially circular central portion 134 and 3 extending legs 136 which get progressively narrower as they radiate away from the central portion. With reference to FIG. 3, the first leg 138 is oriented toward a left-side 140 of the platform 14, the second leg 142 is oriented toward a front-side 144 of the platform 14, and the third leg 146 is oriented toward a right-side 148 of the platform 14.

As best shown in FIGS. 1, 3, and 5, the top portion 120 of each of the dispensing members 116, 118 includes a peripheral "catch" at both the front 150 and the back 152 of the top portion 120. Each of these "catches" engages a "corresponding" in the bottom 20 of the platform 14. With particular reference to FIG. 5, the front "catch" is a notched-out cut 154. The "corresponding" is a sliding latch 156 which is placed in an upper recess 158. The sliding latch 156 is slidingly connected to the platform 14 by a pin 160 having a retaining head, which moves back and forth in a slot 162. The top portion 120 also includes a "catch" at the back 152 of the top portion of 120. This particular "catch" is a locating tab 164, which fits into the corresponding "catch," which in this case is a corresponding slot 166. These front and rear catch mechanisms inhibit or prevent a user from accidentally, or even intentionally, forcing either of the removable dispensing members 116, 118 out of their respective positions. It is also worth noting that both the left-side opening 22 and right-side opening 24 include an annular recess 168. This annular recess 168 corresponds with a stepped annular recess 170 on the lower surface 172 of the top portion 120. In addition, as best shown in FIG. 1, the top portion 120 includes a peripheral edge 174 and a central, vertical axis 176. As can be seen from the Figure, the cross-sectional contour of the top portion 120 is generally concave, with the lowest point of the concave shape being located at the central axis 176.

With reference to FIGS. 1, 4, and 5, the bottom portion 122 of each of the dispensing members 116, 118 is substantially funnel-like in shape. In addition, the orifice 132 of the bottom portion 122 is positioned off center relative to the central axis 176 of the upper end 128 of the bottom portion, the same central axis 176 as found in the top portion 120.

In making a dispenser according to the principals of the invention, any suitable materials may be used, as will readily be understood by those of ordinary skill in the art upon a review of the Summary of the Invention, the drawings, and the Detailed Description of the Drawings. For example, the various components may be made of plastic, with the components being formed by injection molding. If desired, the dispenser support structure, including the platform, the front and rear slide tracks, the back plate, the side panels, and the central vertical plate may be formed as an integral unit. In addition, the access blocking member and the cover each may be formed as its own integral unit. Depending upon the construction of the back plate, it is possible to form the sensing member as an integral unit as well. For example, if each of the channels in the back plate includes a removable panel on the front surface of the back plate, then each of the sensing members may first be positioned into the channel, with the cover panel then being placed in position. Alternatively, the sensing member may be formed as separate pieces which are subsequently fastened together. For example, a separate resting element may be added to an integral connecting portion and blocking element, alternatively, a separate blocking element may be fastened to an integral connecting portion and resting element. With respect to the removable dispensing members, each of these members may be formed either as an integral unit, or as separate top and bottom portions which are subsequently fastened together. In addition to the various methods of manufacture described above, it will be readily apparent to one of ordinary skill in the art that a dispenser according to the principals of the invention may be made in any of a number of other different fashions. For example, various plainer sheets of plastic or any other suitable material may be cut and subsequently fastened together to form the dispenser.

With reference to the Figures, in loading the dispenser, a custodian or other operator simply lifts the cover 76 and props it open by positioning the free end 114 of the cover prop-rod 102 in the detent 92 on the top edge 88 of the vertical plate 86. By way of example, if the access-blocking member 26 is positioned toward the left side 28 of the dispenser 10, as shown in FIG. 2, and both rolls of toweling are being loaded for the first time, the custodian may easily remove the right-side dispensing member 118, remove the cardboard core from a roll of center-pull toweling, pull some of the toweling out from the base of the roll, twist the exposed toweling into a "tail," and feed the tail through the dispensing member 118, including the orifice 132 of the bottom portion 122. He or she then may position the member 118 into the annular recess 168 of the platform bottom 20, and secure the various front and rear "catches" in place. Because the cover 76 is open, the elasticized band or cord 94 has already lifted the sensing member blocking element 48 above the level of the access-blocking member obstruction bar 60. Accordingly, the custodian may slide the access-blocking member to the right side 30 of the dispenser 10.

If the left-side sensing member's blocking element 48 happens to be positioned below the elongated obstruction bar 60 of the access-blocking member 26, as opposed to being positioned above the bar 60 as shown in FIG. 2, this does not present a problem. Because the left-side sensing member 32 also is connected to the cover 76 by an elasticized band or cord 94, the cover 76 may be fully opened and propped up, as discussed above. Because the band 94 is elastic, it simply stretches to accomodate this scenario. In this situation, when the custodian slides the access-blocking member 26 to the right, the left-side sensing member 32 will rise up as the obstruction bar 60 moves past the sensing member's blocking element 48. At this point, the custodian may remove the left-side dispensing member 116 and install a new roll on the left side, as discussed above in conduction with the installation on the right side. At this point, the custodian simply releases the cover prop-rod 102 and closes the cover 76. The access-blocking member 26 now is blocking access to toweling on the right side 30 of the dispenser 10, while enabling users to pull towels from the left side 28 of the dispenser 10.

Therefore, users will not be able to pull towels from the right-side dispensing member 118 until the paper toweling above the left-side dispensing member 116 is depleted. As used herein, the term "depleted" does not require that all of the sheets of a given roll of center-pull paper toweling be removed from a particular side and dispensing member of the dispenser 10. Instead, "depleted" simply means that enough toweling has been removed from the roll so that the corresponding sensing member, which prior to depletion makes contact with the access-blocking member 26 sufficient to prevent the access-blocking member 26 from being moved from one of the first and second positions to the other of the first and second positions, now moves downward to a point just sufficient enough to allow the access-blocking member 26 to be moved to the other of the first and second positions. With reference to FIG. 5, one example of such a downward position is the blocking element 46 shown in phantom and identified by the letter "B". Accordingly, by way of example, once the toweling above the left-side dispensing member 116 is depleted, a user may slide the access-blocking member 26 to the left side 28 of the dispenser 10, thereby providing access to a fill roll of toweling via the right-side dispensing member 118.

In this manner, a custodian may return to the dispenser 10 and install a new roll on the left side 28, well before users have exhausted the roll on the right side 30. This ability of the invention to limit dispensing to one side of the device provides many benefits and advantages, both to users and to custodians. For example, the invention significantly reduces the expense associated with custodians throwing away partially consumed rolls of toweling because of the potential mismatch between the timing of their re-stock visits and the rates of consumption by users. And most importantly, the invention significantly increases the likelihood that, the next time you reach for that much-needed sheet of center-pull paper toweling, you will not come up empty-handed!

In a particular version of the invention designed to accomodate two rolls of toweling, with each roll of toweling having standard dimensions of 8 inches in height and 7¼ inches in diameter, and with the majority of the planar surfaces of the dispenser being formed of materials having a thickness of about ¼ inch, suitable dimensions for the dispenser itself may be as follows:

an overall dispenser width from left to right of about 15½ inches; an overall dispenser depth from front to back of about 9¼ inches; an overall sidewall height of about 14 11/16 inches; a height of about 4½ inches from the bottom of the sidewall to the point where the diagonal portion of the sidewall begins; a cover top to platform bottom height of about 9⅜ inches; a vertical plate height of about 8½ inches and width front to back of about 5 inches; a sensing member width of about 1 inch, height of about 10 11/16 inches, resting element length of about 1¼ inches, and blocking element length and height of about ½ inch; a channel width left to right of about 1 1/16 inches, and depth front to back of about 5/16 inch; an access-blocking member width left to right of about 6 inches, front height of about 2 11/16 inches, front flange length of about ½ inch, base depth front to back of about 7⅛inches, back height of about 2 11/16 inches, back flange length of about ½ inch; an elongated obstruction bar length of about 10 inches, and cross-sectional height and width of about ½ inch by ½ inch; a front slide track external height of about 13/16 inch, external depth front to back of about 13/16 inch, internal height of about 5/16 inch, and internal depth of about ½ inch; a rear slide track external height of about 13/16 inch, internal height of about 5/16 inch and internal depth of about ½ inch; a distance from the back side of a sensing member to the back side of the access-blocking device of about 1 1/16 inches; a distance from the top of the back wall of the access-blocking member to the bottom of the elongated obstruction bar of about 2⅛ inches; a dispensing member top portion diameter of about 6⅝ inches; dispensing member bottom portion dimensions at the orifice of about ⅜ inch by about 7/16 inch; and an angle of about 38 degrees formed between the horizontal base of the access-blocking member and the longitudinal axis running through the funnel-like bottom portion. In this particular version of the invention, the removable dispensing members are formed of materials thinner than ¼ inch in thickness.

While the present invention has been illustrated by a description of various versions, and while the illustrative versions have been described in considerable detail, it is not the intention of the inventor to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A paper towel dispenser, comprising:

a support structure;

a platform forming a part of the support structure and adapted to support two rolls of center-pull paper toweling in side-by-side relationship, the platform having a bottom, a first opening in the bottom, and a second opening in the bottom, each opening capable of receiving paper toweling from an inner end of a roll of center-pull paper toweling; and a selectively positionable access-blocking member attached to the support structure, the access-blocking member having a first position and a second position for alternatingly blocking access to one of the first and second openings while providing access to the other one of the first and second openings;

the platform including a first dispensing member and a second dispensing member, with the first dispensing member being operatively aligned with the first opening, and the second dispensing member being operatively aligned with the second opening, a front, each of the first and second dispensing members including a top portion and a bottom portion, with the bottom portion having an orifice capable of receiving paper toweling from an inner end of a roll of center-pull paper toweling, the orifice located toward the front of the platform relative to the location of the top portion.

2. A paper towel dispenser, comprising:

a support structure;

a platform forming a part of the support structure and adapted to support two rolls of center-pull paper toweling in side-by-side relationship, the platform having a bottom, a first opening in the bottom, and a second opening in the bottom, each opening capable of receiving paper toweling from an inner end of a roll of center-pull paper toweling; and a selectively positionable access-blocking member attached to the support structure, the access-blocking member having a first position and a second position for alternatingly blocking access to one of the first and second openings while providing access to the other one of the first and second openings;

the platform including a first dispensing member and a second dispensing member, with the first dispensing member being operatively aligned with the first opening, and the second dispensing member being operatively aligned with the second opening, the first and second dispensing members further being removable.

3. The dispenser of claim 2 wherein each of the first and second dispensing members includes a peripheral catch, and the platform includes a corresponding catch proximate each of the first and second openings, each peripheral catch and corresponding catch engageable so as to releasably secure each of the first and second dispensing members to the platform.

4. A paper towel dispenser, comprising:

a support structure;

a platform forming a part of the support structure and adapted to support two rolls of center-pull paper toweling in side-by-side relationship, the platform having a bottom, a first opening in the bottom, and a second opening in the bottom, each opening capable of receiving paper toweling from an inner end of a roll of center-pull paper toweling;

a selectively positionable access-blocking member attached to the support structure, the access-blocking member having a first position and a second position for alternatingly blocking access to one of the first and second openings while providing access to the other one of the first and second openings; and at least one sensing member, the sensing member being selectively contactable with the access-blocking member such that, when a roll of center-pull paper toweling is not depleted, the sensing member makes contact with the access-blocking member sufficient to prevent the access-blocking member from being moved from one of the first and second positions to the other of the first and second positions, whereas when a roll of center-pull paper toweling is depleted, the sensing member allows the access-blocking member to be moved from one of the first and second positions to the other of the first and second positions;

the support structure including a back plate having at least one channel, at least a part of the sensing member being positioned within the channel.

5. The dispenser of claim 4 wherein the sensing member includes an upper end with a resting element, a lower end with a blocking element, and a connecting portion between the upper and lower ends.

6. The dispenser of claim 4 further including a cover connected to the support structure, the dispenser also including a lifting member connected to the cover and to the sensing member, whereby when the cover is in an open position, the lifting member lifts the sensing member so that the sensing member no longer makes contact with the access-blocking member sufficient to prevent the access-blocking member from being moved from one of the first and second positions to the other of the first and second positions, thereby enabling the access-blocking member to be moved from one of the first and second positions to the other of the first and second positions.

7. The dispenser of claim 4 wherein the dispenser includes a second sensing member, the second sensing member being selectively contactable with the access-blocking member.

8. A dispensing member for use in a center-pull paper towel dispenser comprising:

a top portion having an aperture capable of receiving paper toweling from an inner end of a roll of center-pull paper toweling; and a bottom portion operatively connected to the top portion, the bottom portion having an upper and connected to the top portion, and a lower end having an orifice capable of receiving paper toweling from an inner end of a roll of center-pull paper toweling;

the aperture in the top portion including a central portion and a plurality of legs extending radially outward from the central portion.

9. A dispensing member for use in a center-pull paper towel dispenser, comprising:

a top portion having an aperture capable of receiving paper toweling from an inner end of a roll of center-pull paper toweling; and a bottom portion operatively connected to the top portion, the bottom portion having an upper end connected to the top portion, and a lower end having an orifice capable of receiving paper toweling from an inner and of a roll of center-pull paper toweling;

the top portion further including a peripheral edge and a central axis, with the top portion being generally concave in cross-section from the peripheral edge toward the central axis.

10. A dispensing member for use in a center-pull paper towel dispenser, comprising:

a top portion having an aperture capable of receiving paper toweling from an inner end of a roll of center-pull paper toweling; and a bottom portion operatively connected to the top portion, the bottom portion having an upper end connected to the top portion, and a lower end having an orifice capable of receiving paper toweling from an inner end of a roll of center-pull paper toweling;

the upper end of the bottom portion having a central axis, and the orifice of the bottom portion being positioned off-center relative to the central axis.

* * * * *

UNITED STATES PATENT AND TRADEMARK OFFICE

CERTIFICATE OF CORRECTION

PATENT NO. : 6,089,499
DATED : July 18, 2000
INVENTOR(S) : Robert S. Robinson

It is certified that error appears in the above-identified patent and that said Letters Patent is hereby corrected as shown below:

Column 2,
Line 15, "principals" should be -- principles --.
Line 19, "principals" should be -- principles --.
Line 33, "principals" should be -- principles --.

Column 3,
Line 22, "within there respectively channels 36, 38" should be -- within their respective channels 36, 38 --.

Column 4,
Line 61, "mounted an upper portion" should be -- mounted on upper portion --.

Column 5,
Line 10, "because of the two dispensing member" should be -- because the two dispensing members --.
Line12, "cross section" should be -- cross-section --.
Line 13, "principals" should be -- principles --.

Column 6,
Line 20, "element" should be -- element; --.
Line 29, "principals" should be -- principles --.
Line 31, "plainer" should be -- planar --.

UNITED STATES PATENT AND TRADEMARK OFFICE

CERTIFICATE OF CORRECTION

PATENT NO. : 6,089,499
DATED : July 18, 2000
INVENTOR(S) : Robert S. Robinson

It is certified that error appears in the above-identified patent and that said Letters Patent is hereby corrected as shown below:

Column 7.
Line 2, "conduction" should be -- conjunction --.
Line 30, "fill" should be -- full --.
Line 40, "re-stock" should be -- restock --.

Column 10,
Line 24, "and" should be -- end --.
Line 40, "and" should be -- end --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*